US010697306B2

(12) United States Patent
Lee et al.

(10) Patent No.: US 10,697,306 B2
(45) Date of Patent: Jun. 30, 2020

(54) GAS TURBINE AIRFOIL INCLUDING INTEGRATED LEADING EDGE AND TIP COOLING FLUID PASSAGE AND CORE STRUCTURE USED FOR FORMING SUCH AN AIRFOIL

(71) Applicant: Siemens Aktiengesellschaft, München (DE)

(72) Inventors: Ching-Pang Lee, Cincinnati, OH (US); Jae Y. Um, Winter Garden, FL (US); Gerald L. Hillier, Charlottesville, VA (US); Wayne J. McDonald, Charlotte, NC (US); Erik Johnson, Cedar Park, TX (US); Anthony Waywood, Cincinnati, OH (US); Eric Schroeder, Loveland, OH (US); Zhengxiang Pu, Oviedo, FL (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 504 days.

(21) Appl. No.: 15/508,497

(22) PCT Filed: Sep. 18, 2014

(86) PCT No.: PCT/US2014/056188
§ 371 (c)(1),
(2) Date: Mar. 3, 2017

(87) PCT Pub. No.: WO2016/043742
PCT Pub. Date: Mar. 24, 2016

(65) Prior Publication Data
US 2017/0275998 A1 Sep. 28, 2017

(51) Int. Cl.
*F01D 5/18* (2006.01)
*F01D 9/02* (2006.01)
*F01D 25/12* (2006.01)

(52) U.S. Cl.
CPC ..... *F01D 5/187* (2013.01); *F01D 9/02* (2013.01); *F01D 25/12* (2013.01);
(Continued)

(58) Field of Classification Search
CPC . F01D 5/187; F01D 9/02; F01D 25/12; F05D 2220/32; F05D 2240/303;
(Continued)

(56) References Cited

U.S. PATENT DOCUMENTS 5,002,460 A * 3/1991 Lee ..... F01D 5/188 415/115
5,340,274 A * 8/1994 Cunha ..... F01D 5/182 415/115

(Continued)

FOREIGN PATENT DOCUMENTS

DE 102014100085 A1 7/2014
GB 2395232 A 5/2004

OTHER PUBLICATIONS

PCT International Search Report and Written Opinion dated Jun. 30, 2015 corresponding to PCT Application PCT/US2014/056188 filed Sep. 18, 2014.

*Primary Examiner* — Aaron R Eastman

(57) ABSTRACT

A core structure (10) includes a first core element (16) including a leading edge section (30), a tip section (32), and a turn section (34) joining the leading edge and tip sections (30, 32). The first core element (16) is adapted to be used to form a leading edge cooling circuit (102) in a gas turbine engine airfoil (100). The leading edge cooling circuit (102) includes a cooling fluid passage (104) having a leading edge portion (106) formed by the first core element leading edge (Continued)

section (30), a tip portion (108) formed by the first core element tip section (32), and a turn portion (110) formed by the first core element turn section (34). Each of the leading edge portion (106), the tip portion (108), and the turn portion (110) of the cooling fluid passage (104) are formed concurrently in the airfoil (100) by the first core element (16).

5 Claims, 5 Drawing Sheets

(52) U.S. Cl.
CPC .... *F05D 2220/32* (2013.01); *F05D 2240/303* (2013.01); *F05D 2250/25* (2013.01); *F05D 2260/201* (2013.01); *F05D 2260/2212* (2013.01)

(58) Field of Classification Search
CPC ..... F05D 2250/25; F05D 2260/201; F05D 2260/2212
USPC ..... 416/96 R
See application file for complete search history.

(56) References Cited

U.S. PATENT DOCUMENTS 5,599,166 A 2/1997 Deptowicz et al.
5,704,763 A 1/1998 Lee
6,068,806 A 5/2000 Dietrich
6,331,098 B1 12/2001 Lee
6,390,774 B1 5/2002 Lewis et al.
6,431,832 B1 8/2002 Glezer et al.
6,609,884 B2 8/2003 Harvey
6,761,535 B1 7/2004 McGrath et al.
6,966,756 B2 11/2005 McGrath et al.
7,004,720 B2 2/2006 Synnott et al.
7,249,933 B2 7/2007 Lee et al.
7,674,093 B2 3/2010 Lee et al.
7,690,894 B1 4/2010 Liang
7,824,156 B2 11/2010 Dellmann et al.
8,192,146 B2 6/2012 Liang
8,347,945 B1 1/2013 Taffet et al.
2008/0264035 A1* 10/2008 Ricciardo ..... F02K 9/64 60/267
2010/0139903 A1 6/2010 Hatman
2010/0239409 A1* 9/2010 Draper ..... F01D 5/005 415/1
2011/0223005 A1 9/2011 Lee et al.
2011/0229343 A1* 9/2011 Farrell ..... F01D 5/186 416/97 R
2012/0269647 A1 10/2012 Vitt et al.
2013/0171005 A1 7/2013 Ellis et al.
2013/0280093 A1 10/2013 Zelesky et al.
2014/0271225 A1* 9/2014 Herzlinger ..... F01D 5/187 416/96 R
2015/0204197 A1* 7/2015 Lee ..... F01D 5/187 416/97 R
2017/0101870 A1* 4/2017 Lewis ..... F01D 5/186

* cited by examiner

GAS TURBINE AIRFOIL INCLUDING INTEGRATED LEADING EDGE AND TIP COOLING FLUID PASSAGE AND CORE STRUCTURE USED FOR FORMING SUCH AN AIRFOIL

TECHNICAL FIELD

The present invention relates to a cooling system for use in an airfoil of a turbine engine, and more particularly, to an integrated leading edge and tip cooling fluid passage and core used for forming the same.

BACKGROUND ART

In gas turbine engines, compressed air discharged from a compressor section and fuel introduced from a source of fuel are mixed together and burned in a combustion section, creating combustion products defining a high temperature working gas. The working gas is directed through a hot gas path in a turbine section of the engine, where the working gas expands to provide rotation of a turbine rotor. The turbine rotor may be linked to an electric generator, wherein the rotation of the turbine rotor can be used to produce electricity in the generator.

In view of high pressure ratios and high engine firing temperatures implemented in modern engines, certain components, such as airfoil assemblies, e.g., stationary vanes and rotating blades within the turbine section, must be cooled with cooling fluid, such as air discharged from a compressor in the compressor section, to prevent overheating of the components.

SUMMARY OF INVENTION

In accordance with a first aspect of the present invention, a core structure used to form a cooling configuration in a gas turbine engine airfoil is provided. The core structure, also referred to herein as a core, comprises a first core element including a leading edge section, a tip section integral with the leading edge section, and a turn section integral with the leading edge and tip sections and joining the leading edge and tip sections. The first core element is adapted to be used to form a leading edge cooling circuit in a gas turbine engine airfoil. The leading edge cooling circuit includes a cooling fluid passage comprising a leading edge portion formed by the first core element leading edge section, a tip portion formed by the first core element tip section, and a turn portion formed by the first core element turn section. The leading edge portion extends radially through the airfoil adjacent to a leading edge of the airfoil, the tip portion extends chordally from adjacent to the leading edge of the airfoil to adjacent to a trailing edge of the airfoil, and the turn portion facilitates fluid communication between the leading edge portion and the tip portion. Each of the leading edge portion, the tip portion, and the turn portion of the cooling fluid passage are adapted to be formed concurrently in the airfoil by the first core element.

The leading edge section of the first core element may include a plurality of helical ridges extending circumferentially and radially with respect to a radial axis of the leading edge section, the ridges forming corresponding helical grooves extending into a surface of the airfoil defining an outer boundary of the leading edge portion of the cooling passage, wherein the grooves effect a helical flow pattern for cooling fluid flowing radially outwardly through the leading edge portion of the cooling passage.

The turn section of the first core element may form the turn portion of the cooling fluid passage such that an angle between the leading edge portion and the tip portion is within a range of 90 degrees to 130 degrees.

The core structure may further comprise a second core element integral with the first core element, the second core element including a mid-chord section used to form a mid-chord cooling circuit in the airfoil concurrently with the first core element forming the leading edge cooling circuit. The mid-chord section may include at least two radial mid-chord elements that form corresponding mid-chord passages of the mid-chord cooling circuit, the mid-chord passages extending generally radially through a mid-chord portion of the airfoil. The second core element may further include a trailing edge section integral with the mid-chord section, the trailing edge section used to form a trailing edge cooling circuit in the airfoil concurrently with the mid-chord section forming the mid-chord cooling circuit.

The leading edge section of the first core element may include first and second radial leading edge elements that form corresponding first and second leading edge passages of the leading edge cooling circuit. The core structure may further comprise a plurality of transition elements extending between the first and second radial leading edge elements, wherein the transition elements are used to form a plurality of transition passages in the airfoil providing fluid communication from the first leading edge passage to the second leading edge passage, and wherein cooling fluid entering the second leading edge passage from the first leading edge passage through the transition passages impinges on a surface of the airfoil defining an outer boundary of the second leading edge passage to provide impingement cooling of the surface. The transition elements may be located closer to one of a first side portion and a second side portion of the second radial leading edge element such that the transition passages are located closer to one of the pressure and suction sides of the airfoil than the other.

The core structure may further comprise an inlet element extending to an end of the leading edge section of the first core element opposed from the turning section, the inlet element being arranged relative to the leading edge section such that an inlet passage formed in the resulting airfoil introduces cooling fluid into the leading edge portion of the cooling passage at an angle of between 25 degrees and 65 degrees relative to a radial axis of the leading edge portion In accordance with a second aspect of the present invention, an airfoil is provided in a gas turbine engine. The airfoil comprises an outer wall including a leading edge, a trailing edge, a pressure side, a suction side, a radially inner end, and a radially outer end, wherein a chordal direction is defined between the leading and trailing edges. The airfoil further comprises a leading edge cooling circuit defined in the outer wall, the leading edge cooling circuit receiving cooling fluid for cooling the outer wall and comprising a cooling fluid passage including: a leading edge portion extending radially through the airfoil adjacent to the leading edge; a tip portion extending chordally from adjacent to the leading edge to adjacent to the trailing edge; and a turn portion that facilitates fluid communication between the leading edge portion and the tip portion. The leading edge portion of the cooling fluid passage includes a plurality of flow directing features that effect a helical flow pattern for cooling fluid flowing radially outwardly through the leading edge portion.

Each portion of the cooling passage, i.e., the leading edge portion, the tip portion, and the turn portion, may be formed concurrently using a first core element of a core structure.

The airfoil may further comprise: a mid-chord cooling circuit that is formed by a mid-chord section of the core structure integral with the first core element, the mid-chord cooling circuit being formed concurrently with the first core element forming the leading edge cooling circuit; and a trailing edge cooling circuit that is formed by a trailing edge section of the core structure integral with the mid-chord section, the trailing edge cooling circuit being formed concurrently with the core structure forming the leading edge cooling circuit.

The leading edge portion of the cooling fluid passage may include first and second leading edge passages extending generally radially through the airfoil, and the airfoil may further comprise a plurality of transition passages providing fluid communication from the first leading edge passage to the second leading edge passage, wherein cooling fluid entering the second leading edge passage from the first leading edge passage through the transition passages impinges on a surface of the airfoil defining an outer boundary of the first leading edge passage to provide impingement cooling of the surface. The transition passages may be located closer to one of the pressure and suction sides of the airfoil than the other.

The flow directing features may comprise grooves extending into a surface of the airfoil defining an outer boundary of the leading edge portion, the grooves extending circumferentially and radially with respect to a radial axis of the leading edge portion. The grooves may extend around the surface of the airfoil defining the outer boundary of the leading edge portion from an inner end of the leading edge portion to an outer end of the leading edge portion.

The airfoil may further comprise an inlet passage that introduces cooling fluid into an inner end of the leading edge portion of the cooling passage at an angle of between 25 degrees to 65 degrees relative to a radial axis of the leading edge portion.

In accordance with a third aspect of the present invention, an airfoil is provided in a gas turbine engine. The airfoil comprises an outer wall including a leading edge, a trailing edge, a pressure side, a suction side, a radially inner end, and a radially outer end, wherein a chordal direction is defined between the leading and trailing edges. The airfoil further comprises a leading edge cooling circuit defined in the outer wall, the leading edge cooling circuit receiving cooling fluid for cooling the outer wall and comprising a cooling fluid passage including: a leading edge portion extending radially through the airfoil adjacent to the leading edge, the leading edge portion including first and second leading edge passages extending generally radially through the airfoil; a tip portion extending chordally from adjacent to the leading edge to adjacent to the trailing edge; a turn portion that facilitates fluid communication between the second leading edge passage of the leading edge portion and the tip portion; and a plurality of transition passages providing fluid communication from the first leading edge passage to the second leading edge passage. Cooling fluid entering the second leading edge passage from the first leading edge passage through the transition passages impinges on a surface of the airfoil defining an outer boundary of the second leading edge passage to provide impingement cooling of the surface.

The second leading edge passage may include a plurality of grooves extending into the surface of the airfoil defining the outer boundary of the second leading edge passage, the grooves extending circumferentially and radially with respect to a radial axis of the leading edge portion to effect a helical flow pattern for cooling fluid flowing radially outwardly through the second leading edge passage.

BRIEF DESCRIPTION OF DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DESCRIPTION OF EMBODIMENTS

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Referring now to FIGS. 1-4, a core 10, also referred to herein as a core structure, used for forming a cooling configuration in an airfoil assembly 100 (shown in FIGS. 5-7), also referred to herein as a gas turbine engine airfoil, in accordance with an aspect of the present invention is illustrated. In the embodiment shown, the core 10 is used to form a blade assembly in a gas turbine engine (not shown), although it is understood that the concepts disclosed herein could be used in the formation of a stationary vane assembly.

Figure 5:
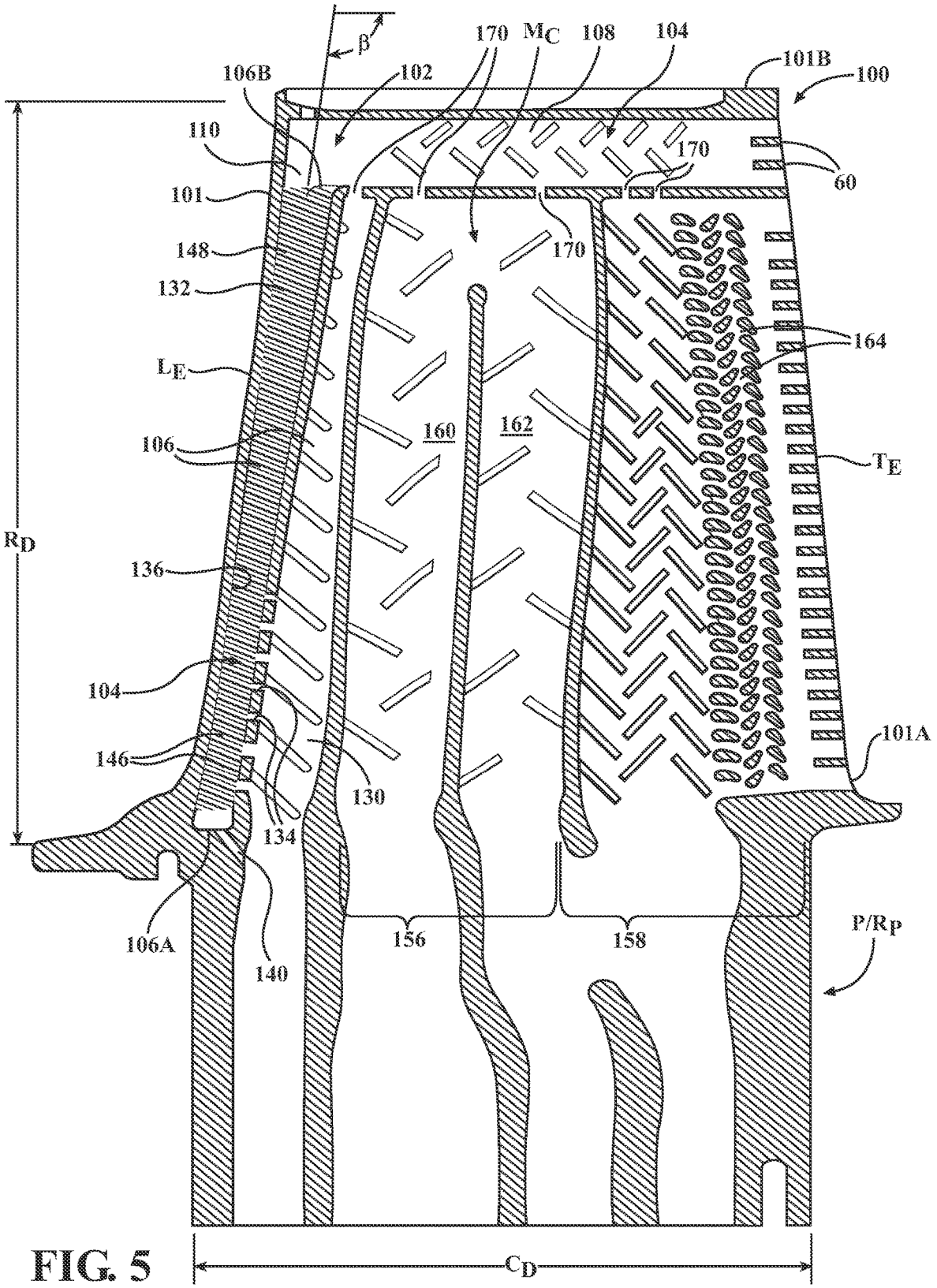
FIG. 5 is side sectional view of an airfoil assembly according to an embodiment of the invention formed using the core of FIG. 1.
Figure 7:
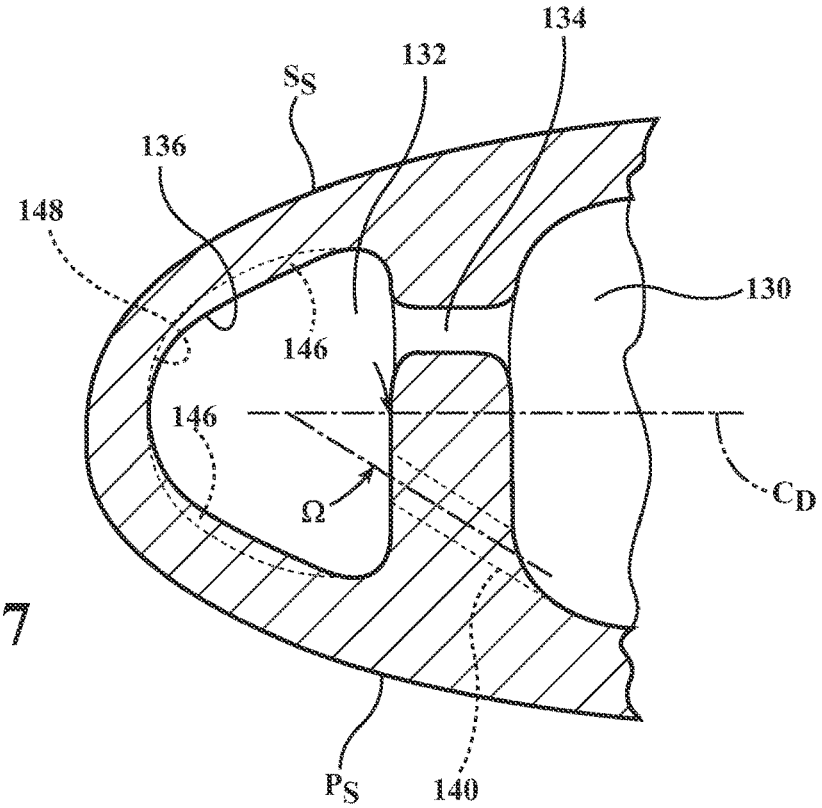
FIG. 7 is a cross sectional view looking in a radially inward direction at a left portion of the airfoil, corresponding to the leading edge of the airfoil assembly shown in FIG. 5.

With reference to FIGS. 5 and 7, the airfoil assembly 100 comprises an outer wall 101 including a leading edge $L_E$, a trailing edge $T_E$, a pressure side $P_S$, a suction side $S_S$, a radially inner end 101A, and a radially outer end 101B, wherein a chordal direction $C_D$ is defined between the leading and trailing edges $L_E$, $T_E$, and a radial direction $R_D$ is defined between the inner and outer ends 101A, 101B.

As will be apparent to those skilled in the art, a gas turbine engine includes a compressor section, a combustor section, and a turbine section. The compressor section includes a compressor that compresses ambient air, at least a portion of which is conveyed to the combustor section. The combustor section includes one or more combustors that combine the compressed air from the compressor section with fuel and ignite the mixture creating combustion products defining a high temperature working gas. The working gas travels to the turbine section where the working gas passes through one or more turbine stages, each turbine stage comprising a row of stationary vanes and a row of rotating blades. The vanes and blades in the turbine section are exposed to the working gas as it passes through the turbine section.

Referring back to FIG. 1, the core 10 includes an airfoil section 12 and a platform/root section 14. The airfoil section 12 of the core 10 comprises a first core element 16 located toward a leading edge 18 and toward a tip 20 of the core 10, and a second core element 22 located toward a trailing edge 24 and at a mid-chord area 26 of the core 10. The platform/root section 14 of the core 10 may have any suitable configuration and is provided for forming a platform/root portion $P/R_P$ of the airfoil assembly 100.

The first core element 16 includes a leading edge section 30 (also referred to herein as a first core element leading edge section), a tip section 32 (also referred to herein as a first core element tip section) integral with the leading edge section 30, and a turn section 34 (also referred to herein as a first core element turn section) integral with the leading edge and tip sections 30, 32. The turn section 34 is formed at a junction 36 between the leading edge and tip sections 30, 32 and joins the leading edge and tip sections 30, 32.

Figure 1:
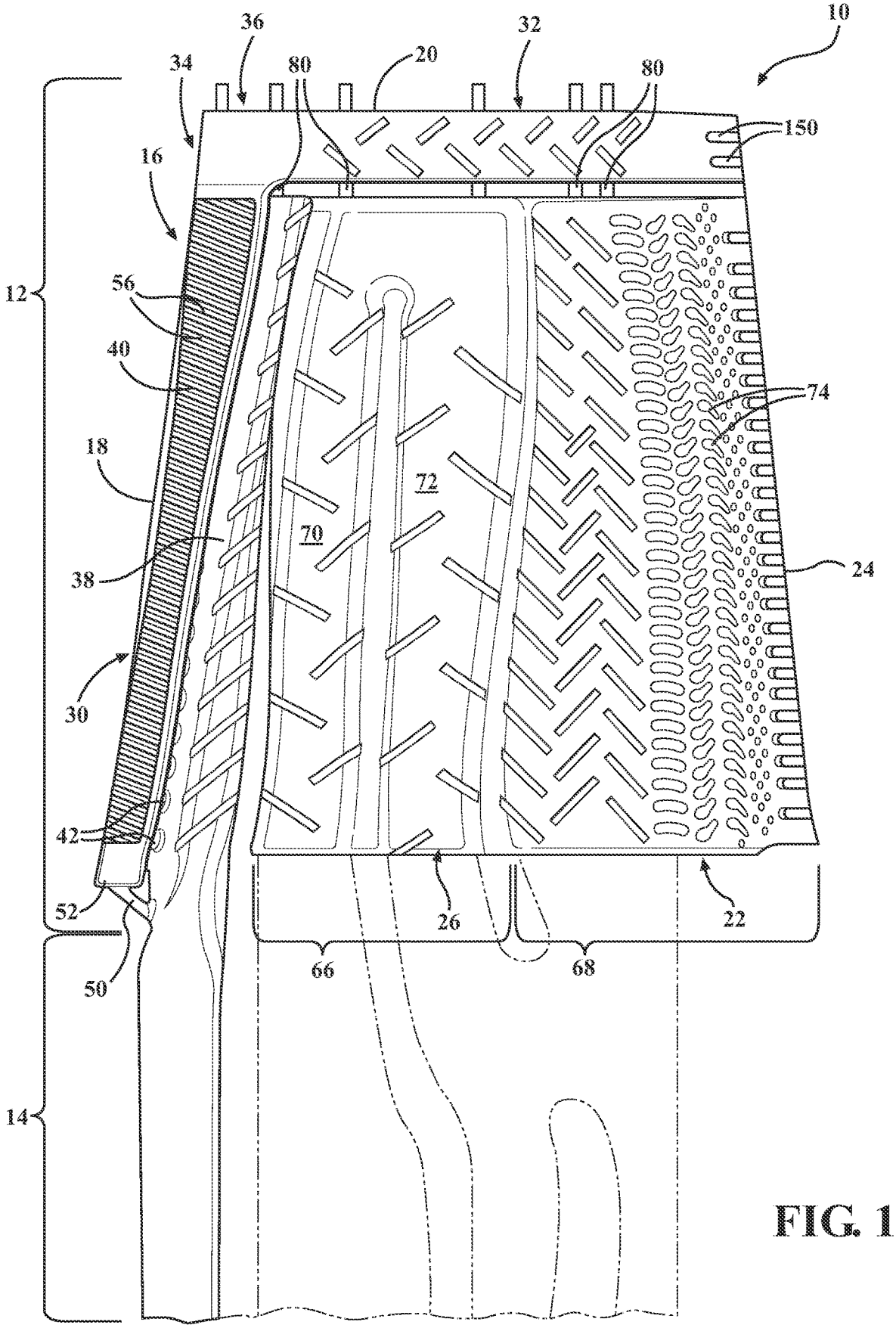
FIG. 1 is a side sectional view of a core according to an embodiment of the invention used for forming an airfoil assembly for a gas turbine engine.

In accordance with an aspect of the present invention, referring to FIGS. 1 and 5, the first core element 16 is used to form a leading edge cooling circuit 102 in the airfoil assembly 100. With reference to FIG. 5, the leading edge cooling circuit 102 includes a cooling fluid passage 104 comprising: a leading edge portion 106, which is formed by the first core element leading edge section 30; a tip portion 108 formed by the first core element tip section 32; and a turn portion 110 formed by the first core element turn section 34, wherein the turn portion 110 effects fluid communication between the leading edge and tip portions 106, 108.

The leading edge portion 106 of the cooling fluid passage 104 extends in the radial direction $R_D$ as shown in FIG. 5 through the airfoil assembly 100 adjacent to the leading edge $L_E$ of the airfoil assembly 100. The tip portion 108 extends in the chordal direction $C_D$ as shown in FIG. 5 from adjacent to the leading edge $L_E$ of the airfoil assembly 100 to adjacent to the trailing edge $T_E$ of the airfoil assembly 100 near the radially outer end 101B of the airfoil assembly 100. The turn portion 110 of the cooling fluid passage 104 is preferably formed by the first core element turn section 34 such that an angle β between the leading edge portion 106 and the tip portion 108 is within a range of 90 degrees to 130 degrees, see FIG. 5. In accordance with an aspect of the present invention, each of the leading edge portion 106, the tip portion 108, and the turn portion 110 of the cooling fluid passage 104 are formed concurrently in the airfoil assembly 100 by the first core element 16 of the core 10.

Figure 6:
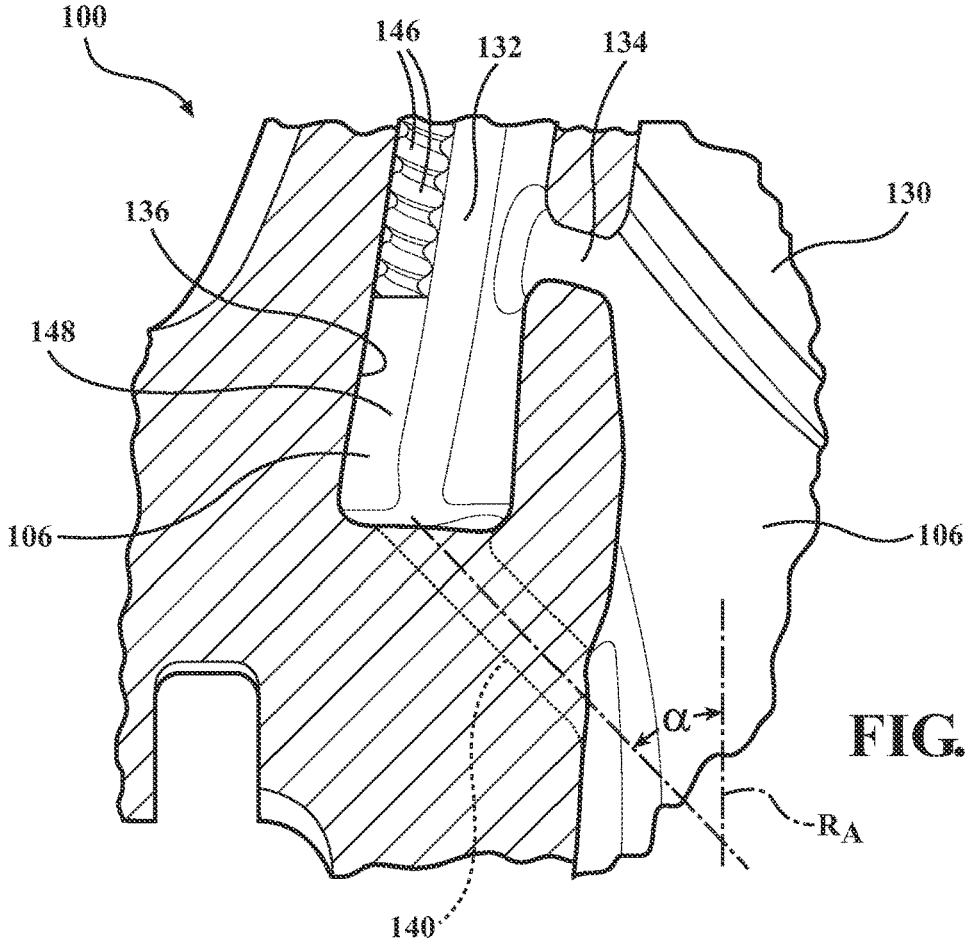
FIG. 6 is an enlarged view of a lower left portion of the airfoil assembly of FIG. 5.

Referring to FIG. 1 with additional reference to FIGS. 2-7, the first core element leading edge section 30 includes first and second radial leading edge elements 38, 40 that form corresponding first and second leading edge passages 130, 132 of the leading edge cooling circuit 102, see FIGS. 5-7. The first core element leading edge section 30 further includes a plurality of transition elements 42 extending generally chordally between the first and second radial leading edge elements 38, 40. The transition elements 42 form a plurality of transition passages 134 in the airfoil assembly 100, wherein the transition passages 134 provide fluid communication from the first leading edge passage 130 to the second leading edge passage 132. During operation, cooling fluid entering the second leading edge passage 132 from the first leading edge passage 130 through the transition passages 134 impinges on a surface 136 of the airfoil assembly 100 defining an outer boundary of the second leading edge passage 132 to provide impingement cooling of the surface 136, see FIG. 5-7.

Figure 3:
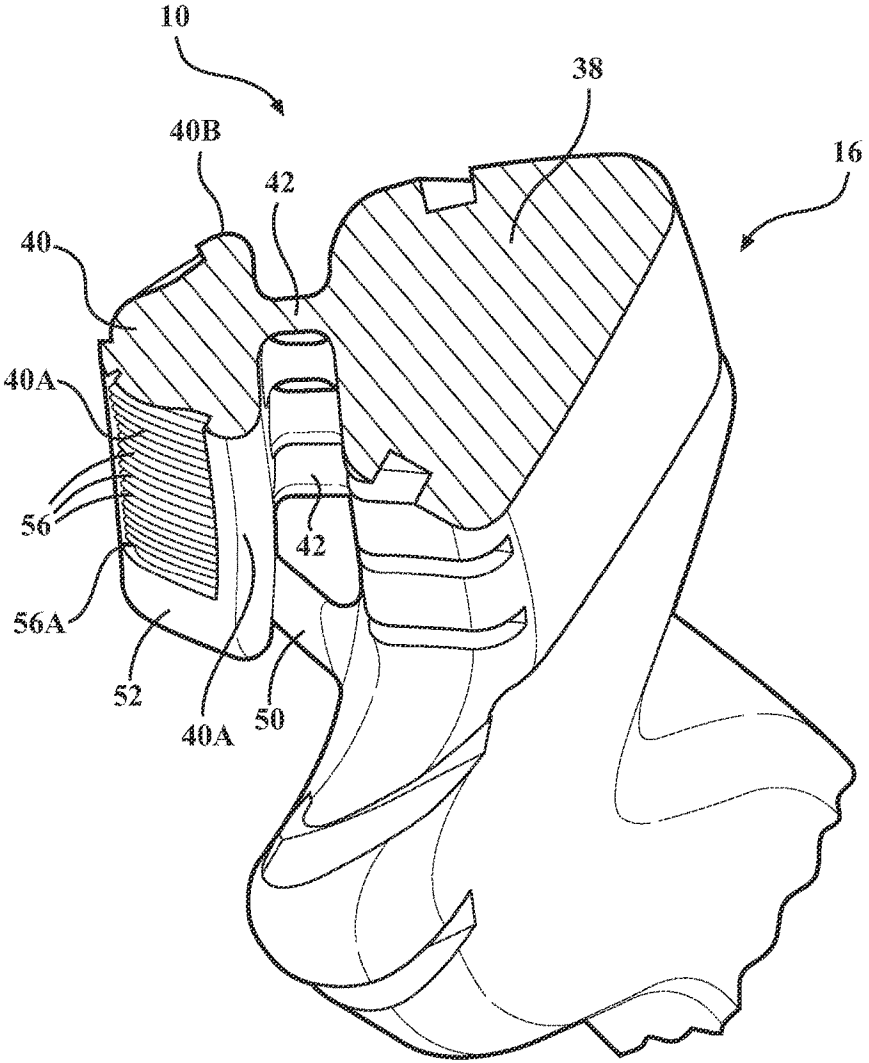

With reference to FIGS. 3 and 7, the transition elements 42 of the core 10 are located further from a first side portion 40A of the second radial leading edge element 40 than to a second side portion 40B of the second radial leading edge element 40, i.e., the transition elements 42 are located closer to the second side portion 40B than to the first side portion 40A of the second radial leading edge element 40, such that the resulting transition passages 134 are located closer to the suction side $S_S$ than to the pressure side $P_S$ of the airfoil assembly 100. The location of the transition passages 134 in this manner promotes a circular or helical flow of cooling fluid through the second leading edge passage 132 during operation. It is noted that the same effect could be produced by forming the transition elements 42 of the core 10 closer to the first side portion 40A than to the second side portion 40B of the second radial leading edge element 40, wherein the resulting transition passages 134 would be located closer to the pressure side $P_S$ than to the suction side $S_S$ of the airfoil assembly 100, such that this aspect of the invention is also intended to cover this alternate location of the transition elements 42 and the resulting transition passages 134.

Referring now to FIGS. 2-4, 6, and 7, the core 10 may also comprise an inlet element 50 extending to an inner end 52 of the first core element leading edge section 30, wherein the inner end 52 is opposed from the first core element turning section 34. The inlet element 50 is preferably arranged relative to the leading edge section 30 such that a resulting inlet passage 140 formed in the airfoil assembly 100 introduces cooling fluid into the leading edge portion 106, i.e., into the second leading edge passage 132 of the leading edge portion 106, of the cooling passage 104 at an angle α of, for example, between 25 degrees and 65 degrees relative to a radial axis $R_A$ of the leading edge portion 106, see FIG. 6. Further, as shown in FIG. 7, the inlet passage 140 may also be arranged at an angle Ω of, for example, about between 25 degrees to 65 degrees relative to the choral direction $C_D$. The configuration of the inlet passage 140 in this manner further assists in promoting a circular or helical flow of cooling fluid through the second leading edge passage 132.

Figure 2:
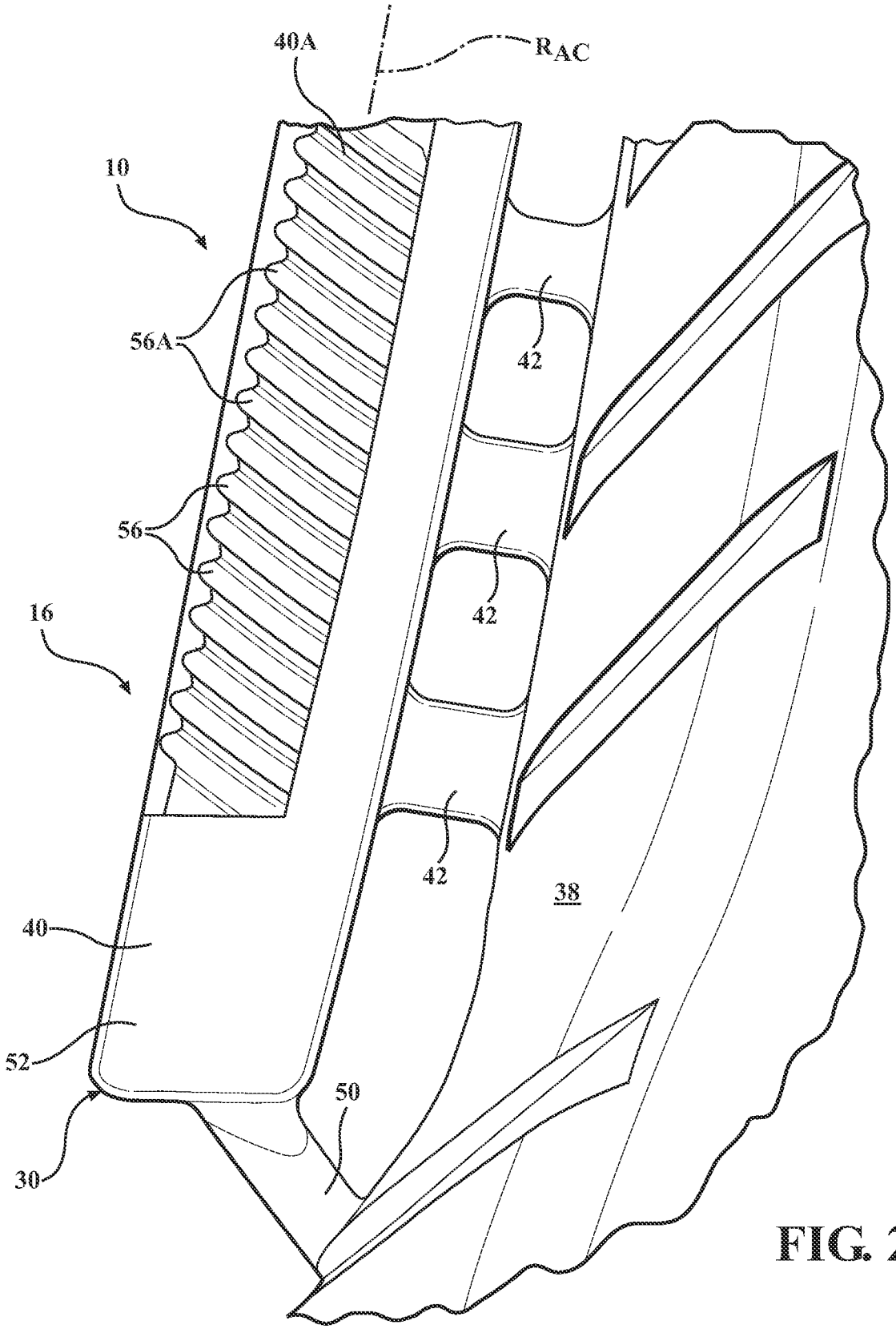
FIG. 2 is an enlarged view of a lower left portion of the core of FIG. 1.
Figure 4:
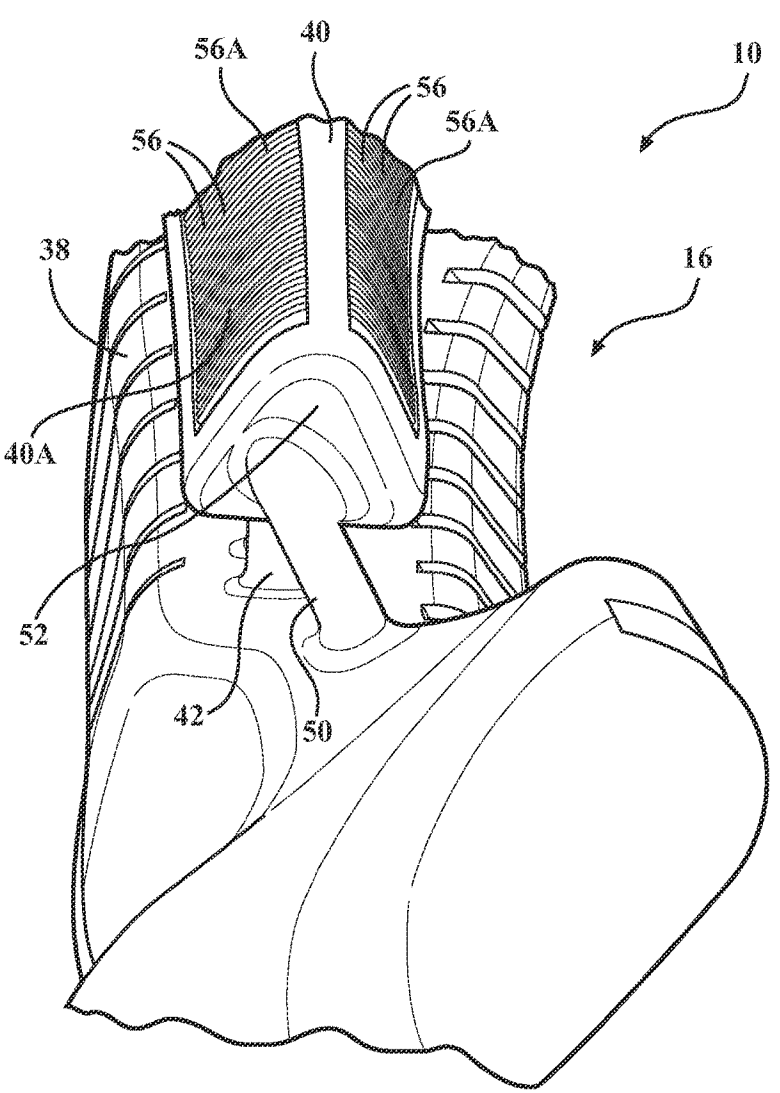
FIGS. 3 and 4 are enlarged perspective views taken from different angles of the lower left portion of the core shown in FIG. 2.

Referring now to FIGS. 1-4, the first core element leading edge section 30, and, more particularly, the second radial leading edge element 40 thereof, includes a plurality of helical ridges 56 extending circumferentially and radially with respect to a radial axis $R_{AC}$ of the leading edge section 30, see FIG. 2. The ridges 56 may extend continuously around an outer surface 40A of the second radial leading edge element 40, or may be broken up into individual pieces 56A extending outwardly from the surface 40A as shown in FIGS. 2-4. The ridges 56 form corresponding flow directing features, illustrated in FIGS. 5-7 as helical grooves 146 that extend into a surface 148 of the airfoil assembly 100 defining an outer boundary of the second leading edge passage 132 of the leading edge portion 106 of the cooling passage 104. The grooves 146 extend around the surface 148 of the airfoil assembly 100 from an inner end 106A of the leading edge portion 106 to an outer end 106B of the leading edge portion 106, see FIG. 5. During operation, the grooves 146 effect a continuous circular or helical flow pattern for cooling fluid flowing radially outwardly through the leading edge portion 106 of the cooling passage 104.

Referring back FIGS. 1 and 5, the turn and tip sections 32, 34 of the core 10 are located toward the outer end of the core 10 to form the tip and turn portions 108, 110 of the airfoil assembly 100 at the outer end 101B thereof. The tip section 32 of the core 10 includes outlet structures 60 that form corresponding cooling fluid outlets 150 in the tip portion 108 of the airfoil assembly 100, wherein the cooling fluid outlets 150 are provided for discharging cooling fluid from the airfoil assembly 100 during operation.

Still referring to FIGS. 1 and 5, the second core element 22, which is integral with the first core element 16 in accordance with an aspect of the present invention, includes a mid-chord section 66 and a trailing edge section 68. While the mid-chord and trailing edge sections 66, 68 of the second core element 22 could have any suitable shape and configuration, the mid-chord section 66 illustrated in FIG. 1 includes first and second radial mid-chord elements 70, 72 arranged, and the trailing edge section 68 includes airfoil shaped cooling structures 74.

The mid-chord and trailing edge sections 66, 68 of the second core element 22 are used to form corresponding mid-chord and trailing edge cooling circuits 156, 158 in the airfoil assembly 100 concurrently with the first core element 16 forming each of the components of the leading edge cooling circuit 102, e.g., the first and second leading edge passages 130, 132 of the leading edge portion 106 of the cooling fluid passage 104, and the tip portion 108 and turn portion 110 of the cooling fluid passage 104. Hence, separate core structures are not required for forming the leading edge, mid-chord, and trailing edge cooling circuits 102, 156, 158 in the airfoil assembly 100.

As shown in FIG. 5, the first and second radial mid-chord elements 70, 72 of the second core element 22 form corresponding mid-chord passages 160, 162 of the mid-chord cooling circuit 156, wherein the mid-chord passages 160, 162 extend generally radially through a mid-chord portion $M_C$ of the airfoil assembly 100 in a serpentine configuration. Also shown in FIG. 5 are airfoil shaped cooling passages 164 formed in the trailing edge cooling circuit 158 by the airfoil shaped cooling structures 74 of the core 10. As noted above, the components of the mid-chord, and trailing edge cooling circuits 156, 158 shown in FIG. 5 are exemplary and the invention is not intended to be limited to the configuration of the mid-chord, and trailing edge cooling circuits 156, 158 shown in FIG. 5.

It is noted that small holes 170 may be formed in the airfoil assembly 100 between the tip potion 108 and any or all of the leading edge, mid-chord, and trailing edge cooling circuits 102, 156, 158, see FIG. 5. The holes 170 may be the result of corresponding pedestals 80 (see FIG. 1) formed in the core 10, which pedestals 80 provide structural integrity for the core 10. While the holes 170 may provide a small amount of cooling fluid leakage between the tip potion 108 and any or all of the leading edge, mid-chord, and trailing edge cooling circuits 102, 156, 158, it is not believed to be a significant amount of cooling fluid, and it is not believed to significantly affect the cooling performance of cooling fluid flowing through the airfoil assembly 100.

It is further noted that parts of the core 10 may include conventional cooling enhancement structures, such as turbulating features, e.g., trip strips, bumps, dimples, etc., which form corresponding cooling features in the airfoil assembly to enhance cooling effected by the cooling fluid flowing through the airfoil assembly during operation.

As noted above, each of the leading edge portion 106, the tip portion 108, and the turn portion 110 of the cooling fluid passage 104 are formed concurrently in the airfoil assembly 100 by the first core element 16 of the core 10, wherein the mid-chord, and trailing edge cooling circuits 156, 158 are also formed at this time. The platform/root portion $P/R_P$ of the airfoil assembly 100 may additionally be formed at this time. Forming these parts of the airfoil assembly 100 with a common core 10 during a single formation process, such as during a casting process, is believed to be advantageous over prior art methods where separate parts of an airfoil assembly are formed by separate cores and during separate procedures.

During operation, the leading edge portion 106 of the cooling fluid passage 104 of the leading edge cooling circuit 102 of the airfoil assembly 100 receives cooling fluid, such as, for example, compressor discharge air from the platform/root portion $P/R_P$ of the airfoil assembly 100, see FIG. 5. As the cooling fluid flows radially outward through the first leading edge passage 130 it provides convective cooling to the airfoil assembly 100.

Portions of the cooling fluid flowing through the first leading edge passage 130 enter the second leading edge passage 132 through the inlet passage 140 and through the transition passages 134. As noted above, the inlet and transition passages 140, 134 are preferably formed so as to promote a circular or helical flow of cooling fluid through the second leading edge passage 132, wherein the grooves 146 promote continued circular or helical flow through the second leading edge passage 132. As the cooling fluid flows radially outward through the second leading edge passage 132 it provides further cooling to the airfoil assembly 100 at the leading edge $L_E$. Moreover, as noted above, the cooling fluid entering the second leading edge passage 132 from the first leading edge passage 130 through the transition passages 134 impinges on the surface 148 of the airfoil assembly 100 to provide impingement cooling of the surface 148 at the leading edge $L_E$.

After flowing radially outwardly through the second leading edge passage 132, the cooling fluid enters the turn portion 110 of the cooling fluid passage 104, wherein the turn portion 110 effects fluid communication between the second leading edge passage 132 and the tip portion 108 of the cooling fluid passage 104. As the cooling fluid flows through the tip portion 108, the cooling fluid provides cooling to the radially outer end 101B of the airfoil assembly 100. The cooling fluid then exits the airfoil assembly 100 via the cooling fluid outlets 150.

Additional cooling fluid enters the mid-chord and trailing edge cooling circuits 156, 158 of the airfoil assembly 100 from the platform/root portion $P/R_P$, which cooling fluid provides cooling to these areas of the airfoil assembly 100 as will be appreciated by those having ordinary skill in the art.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An airfoil in a gas turbine engine comprising:

an outer wall including a leading edge, a trailing edge, a pressure side, a suction side, a radially inner end, and a radially outer end, wherein a chordal direction is defined between the leading and trailing edges;

a leading edge cooling circuit defined in the outer wall, the leading edge cooling circuit receiving cooling fluid for cooling the outer wall and comprising:

a cooling fluid passage including:

a leading edge portion extending radially through the airfoil adjacent to the leading edge;

a tip portion extending chordally from adjacent to the leading edge to adjacent to the trailing edge; and a turn portion that facilitates fluid communication between the leading edge portion and the tip portion;

wherein the leading edge portion of the cooling fluid passage includes a plurality of flow directing features that effect a helical flow pattern for cooling fluid flowing radially outwardly through the leading edge portion;

wherein the leading edge portion of the cooling fluid passage includes first and second leading edge passages extending generally radially through the airfoil, a plurality of transition passages providing fluid communication from the first leading edge passage to the second leading edge passage, wherein cooling fluid entering the second leading edge passage from the first leading edge passage through the transition passages impinges on a surface of the airfoil defining an outer boundary of the second leading edge passage to provide impingement cooling of the surface, and wherein:

the flow directing features comprise grooves extending into a surface of the airfoil defining an outer boundary of the leading edge portion, the grooves extending circumferentially and radially with respect to a radial axis of the leading edge portion; and the grooves extend around the surface of the airfoil defining the outer boundary of the leading edge portion from an inner end of the leading edge portion to an outer end of the leading edge portion.

2. The airfoil according to claim 1, wherein each portion of the cooling passage is formed concurrently with the other portions using a first core element of a core structure.

3. The airfoil according to claim 2, further comprising:

a mid-chord cooling circuit that is formed by a mid-chord section of the core structure integral with the first core element, the mid-chord cooling circuit being formed concurrently with the first core element forming the leading edge cooling circuit; and a trailing edge cooling circuit that is formed by a trailing edge section of the core structure integral with the mid-chord section, the trailing edge cooling circuit being formed concurrently with the core structure forming the leading edge cooling circuit.

4. The airfoil according to claim 1, wherein the transition passages are located closer to one of the pressure and suction sides of the airfoil than the other.

5. The airfoil according to claim 1, further comprising an inlet passage that introduces cooling fluid into an inner end of the leading edge portion of the cooling passage at an angle of between 25 degrees to 65 degrees relative to a radial axis of the leading edge portion.

* * * * *